US005279841A

United States Patent [19]

Yu

[11] Patent Number: 5,279,841

[45] Date of Patent: Jan. 18, 1994

[54] DUAL CONTAINER CONNECTING RING AND THE COMBINATION THEREOF

[76] Inventor: Chine-Min Yu, 5521 Sierra Verde Rd., Irvine, Calif. 92715

[21] Appl. No.: 801,540

[22] Filed: Dec. 2, 1991

[51] Int. Cl.[5] ..... B65D 21/02

[52] U.S. Cl. ..... 426/131; 426/119; 426/120; 206/503; 206/821; 403/265; 220/23.83; 220/906

[58] Field of Search ..... 426/131, 120, 119; 220/23.83, 23.86, 906; 206/501, 503, 430, 427, 821; 403/265

[56] References Cited

U.S. PATENT DOCUMENTS

| | | | |
|---|---|---|---|
| 1,803,566 | 5/1931 | Sexton | 206/501 |
| 1,814,180 | 7/1931 | Nicholls | 206/503 |
| 1,939,719 | 12/1933 | Nicholls | 206/501 |
| 1,984,570 | 12/1934 | Emmons | 206/501 |
| 2,256,024 | 9/1941 | Hill | 206/503 |
| 2,553,559 | 5/1951 | Eckman | 206/503 |
| 2,679,281 | 5/1954 | Paulucci | 206/430 |
| 2,784,131 | 3/1957 | Fletcher | 206/503 |
| 2,866,571 | 12/1958 | Henchert | 220/23.83 |
| 2,963,194 | 12/1960 | Brennan et al. | 220/23.83 |
| 2,996,180 | 8/1961 | Bruce | 206/430 |
| 3,113,668 | 12/1963 | Taylor | 206/430 |
| 3,180,537 | 4/1965 | Collins | 206/501 |
| 3,310,195 | 3/1967 | Wabner et al. | 220/23.83 |
| 3,317,087 | 5/1967 | Landis | 206/427 |
| 3,322,323 | 5/1967 | Greene et al. | 206/503 |
| 3,417,895 | 12/1968 | Penton | 220/23.83 |
| 3,885,672 | 5/1975 | Westenrieder | 206/503 |
| 3,902,992 | 9/1975 | Schuster | 206/427 |
| 4,981,214 | 1/1991 | Rojas | 206/430 |
| 5,076,430 | 12/1991 | Philpot | 220/23.83 |

FOREIGN PATENT DOCUMENTS

| | | | |
|---|---|---|---|
| 692439 | 8/1951 | United Kingdom | 206/430 |
| 946802 | 1/1964 | United Kingdom | 206/501 |

*Primary Examiner*—Steven Weinstein
*Attorney, Agent, or Firm*—Chine-Min Yu

[57] ABSTRACT

The container (2) consists of two individual cans united by an easy separated connecting ring (4) so that the subject container (2) provide to the consumer with more functions and more flexibilities and due to this special design derive a series combination drink packing system FIG. 6.1 to FIG. 6.4 and people can enjoy more and more different kind of drinks and flavors in a very convenance way just to separate the container and to mix them making a lot of drink choice and to carry this so called container to any where and any time to meet the consumer's need at this Space Age.

2 Claims, 7 Drawing Sheets

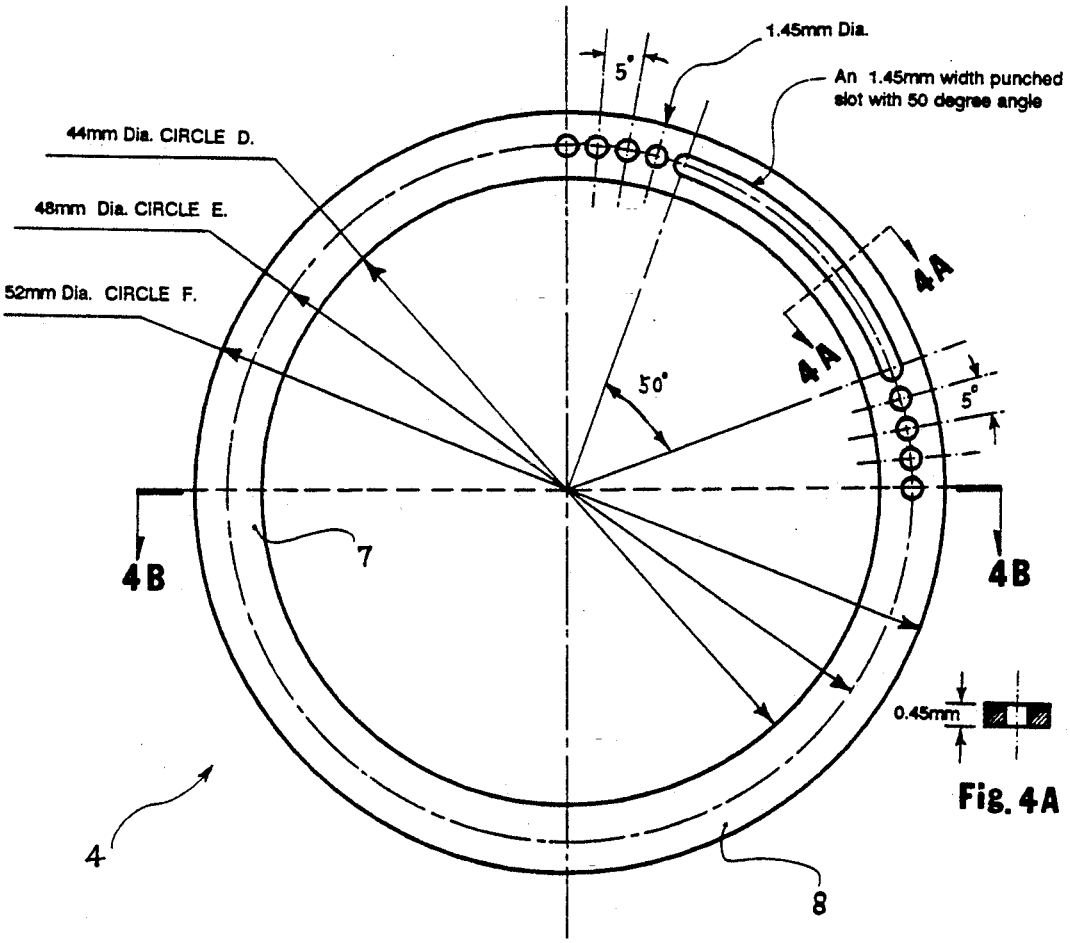
Fig. 4A
Fig. 4
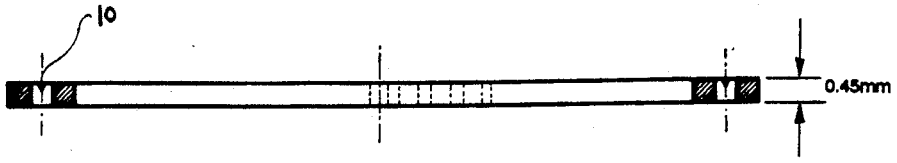
Fig. 4 B

DUAL CONTAINER CONNECTING RING AND THE COMBINATION THEREOF

BACKGROUND

1. Field of Invention

This invention relates to a new type of container using to fill with all kind of drinks and can be separated from one to two instantly.

2. Description of Prior Art

There is not any more an era of the manufacturing to lead the consumer to their products. On the contrary, the consumer has the right to choose their product that has more functions and more flexibilities. The traditional aluminum container of the drink is an old design that no longer meet the requirements of the space age.

After a long time of observation of the consumer's drinking habits, when they enjoy the drink the most is the first couple of mouthfuls and then the taste will decrease gradually. This is the reason people always leave the unfinished drink and are not willing to finish it anymore. Beside that, the evaporation of the carbonated water will reduce the flavor and the taste as well.

The size of an aluminum container does not meet the need of the consumer. When you can't finish a whole can of drink and you don't want to throw it away, the opened can will give you many troubles. If you put it back to an ice box the taste is no longer as fresh as a new one. Before you only had one can of drink and there is no way to share with someone else unless you have an extra cup or just say sorry. Also the old design needless to say its only size totally ignores the children's need.

People who like to drink beer know the taste makes a lot of difference between the beginning mouthful and the last drop. Even on the half way they already find the rest of the beer is not enjoyable any more. How many times have you forced yourself to finish a drink? Is this your fault? Not really, it is because you don't have too many choices. If you want to have two different flavors in a single container so you can enjoy twice the flavor and twice the freshness and without drinking too much and it is almost impossible. And if you spill it then you lose the whole can.

If you like to have an instant cocktail or ginger ale or you want to have juice with soda . . . etc., but you just can't find this kind of drink from the traditional aluminum can. Everyone has their own taste, and the traditional aluminum container apparently cannot satisfy their need. The tradition packing limited the development of drink itself. That is the reason why in nearly a century we still using this traditional can without any break through in this territory. We should not be just satisfied with its easy carrying and easy opening. We have a lot of new things to explore in our drinking industry.

In brief the current aluminum can have following inconveniences:

(a) The can can't provide more choices once you opened it.
(b) the can's volume toward to its taste is over filled.
(c) The can can't split into two cans for more functions.
(e) The can can't provide twice freshness and twice flavors.
(f) The can causes people waste more money.
(g) The can's sanitary concern is always existing.

OBJECTS AND ADVANTAGES

Accordingly, several objects and advantages of my invention are:

(a) The container provides more choice after opened.
(b) The container reserves the taste of other half after opened.
(c) The container can be separated instantly.
(d) The container can provide two different flavor or any kind of combinations and mixed them on the spot.
(f) The container let people save money and have more fun.
(g) The container will not spill all if it falls down.
(h) The container provides a better shape to hold it.
(i) The container provides more strong base for anti-crush loss.
(j) The container can pack in six with recycle material polyester, actually they carry 12 individual cans at the same time.

This new design is from the standpoint of consumer not from the manufacturing, and this is the tide of consumer trend at space age.

According to my present invention, a ring for detachably connecting two cans together end-to-end when said ring is provided with a bonding material; said ring comprising an inner circumferential portion and an integral concentric outer circumferential portion such that said portions share a common border between them; said ring further comprising a plurality of elongated curved slots and a plurality of groups, each group comprising a number of circumferentially grouped small adjacent holes, said slots and groups of holes alternating with each other in a repetitive array of slots and groups of holes circumferentially around said ring and positioned along the common border between said inner portion and said outer portion of said ring; said ring also including at least two V-shaped notches which are also positioned along the common border; said ring being dimensioned to fit the ends of two cans to be secured to each other end-to-end; said slots, small holes and associated V-shaped notches being configured and dimensioned relative to each other and said ring such that when said bonding material is applied both to the upper surface of said ring along said outer portion and on the lower surface of said ring along said inner portion and the cans to be joined are joined to each other end-to-end by being bonded to said upper and lower surface of said ring, respectively, and such that when said joined cans are to be disconnected, twisting said cans in opposite directions will cause said inner portion of said ring and said outer portion of said ring to remain bonded to their respective cans and cause said inner portion and said outer portion of said ring to completely separate from each other into two separate rings, thus separating the cans from each other. According to a further embodiment of my invention, a beverage container assembly is provided which comprises:

(a) a first normally closed beverage container having a first top and first bottom wherein said first top has a first opening means operable to gain access into said first normally closed beverage container; and
(b) a second normally closed beverage container having a second top and a second bottom wherein said second top has a second opening means operable to gain access into said second normally closed beverage container; wherein said first and second beverage container being joined to each other with the first bottom of said first container connected to said second bottom of said second container by said connecting ring described above wherein said first bottom bonded by said bonding material to said upper surface of said ring and said second bottom bonded to said lower surface of said ring.

BRIEF DESCRIPTION OF THE DRAWINGS

In the drawing I will show how the container looks like and how they combined together.

FIGS. 4, 4A and 4B shows the detail of the connecting ring.

REFERENCE NUMERALS IN DRAWINGS

| | |
|---|---|
| 1 top cap | 2 container |
| 3 upper can | 4 connecting ring |
| 5 lower can | 6 bottom cap |
| 7 inner portion of the ring | 8 outer portion of the ring |
| 9 bond material | 10 V-Shape notch |

DESCRIPTION—FIGS. 1 TO 7

Figure 1:
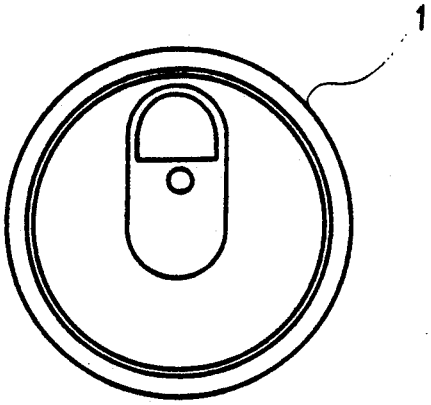
FIGS. 1 and 1A show the top view and side view of the new container.
Figure 1A:
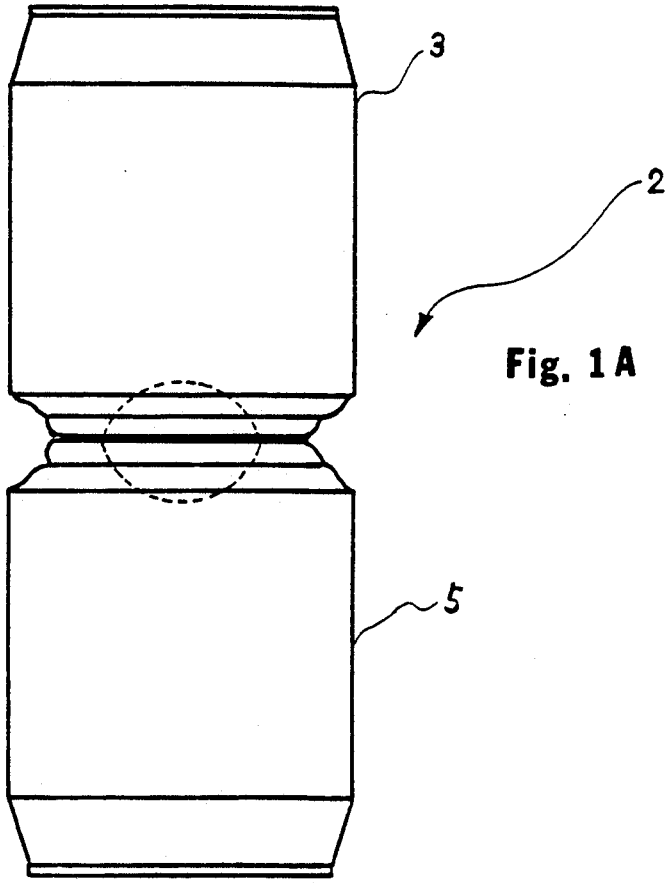

FIG. 1 shows the container's top view the top cap (1) and its side view. The size of the container (2) can either higher than or equal to the current aluminum can that filled with soft drink or alcoholic drink or beer or combination any of them. The container (2) FIG. 1A shows two cans connected together with ones bottom to the others bottom. The two cans that make-up the container (2) can either be equal in volume or vary in volume depending on what type of the drink. The middle part of the container (2) provides an easy shape for comfortable feeling of holding. People can open the container (2) from either end of the drink. Of course it is very easy to separate the container (2) into two cans for two peoples to drink, or enjoy the double freshness and double taste by alone.

Figure 2:
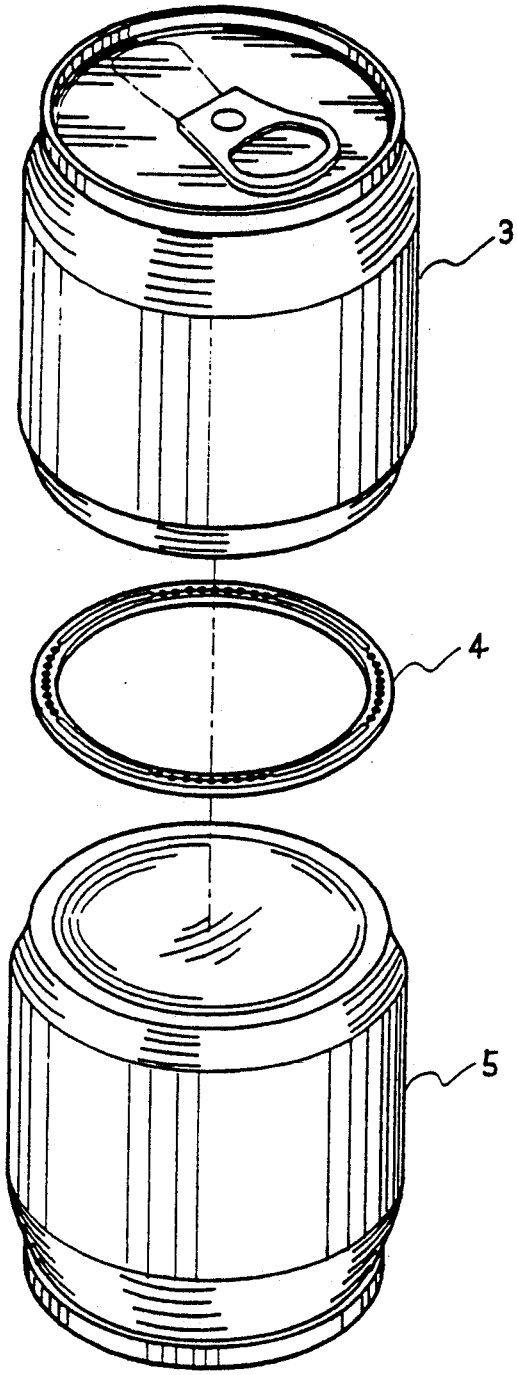
FIG. 2 shows the overall looking of the container and its exploded view.

FIG. 2 shows the container's exploded view, the container consists of three portions: upper can (3) and the connecting ring (4) and the lower can (5). Both the upper can (3) and the lower can (5) are the same except the diameter of the top can (1) of the lower can (5). The smaller top cap of the lower can (5) that will let it easy to stack on the upper can's top cap (1).

Figure 3:
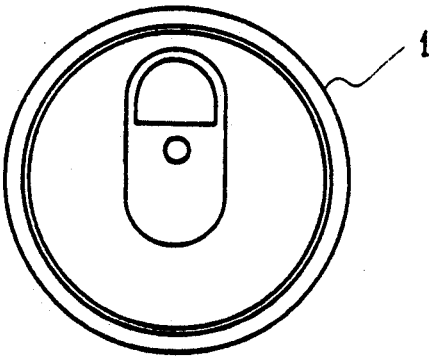
FIGS. 3, 3A and 3B show the relation of the connecting ring and the cans.
Figure 3A:
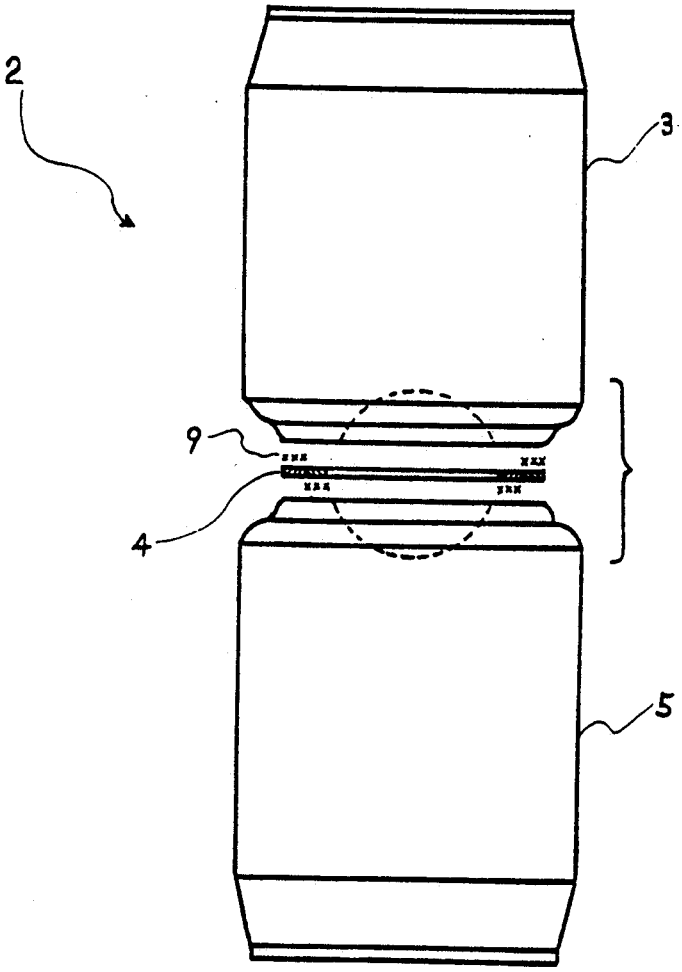
Figure 3B:
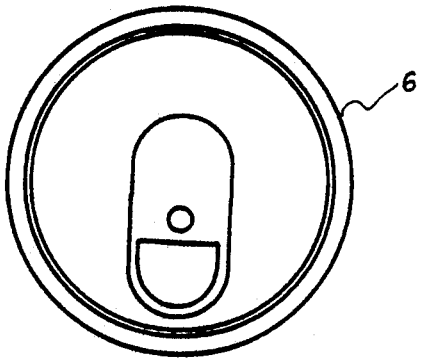

FIG. 3 shows the relation of the ring and the cans. The diameter of the top cap (1) is bigger than the diameter of the lower can's bottom cap (6). The connecting ring (4) made by a 0.45 mm thickness aluminum sheet, the outer portion of the connecting ring (8) of the connecting ring (4) bonds to the bottom of the upper can (3), and the inner portion of the connecting ring (7) of the connecting ring (4) bonds to the bottom of the lower can (5), thus makes the ring very special. Bond material (9) apply on both side of the connecting ring (4) at a specific place that is above the inner portion of the connecting ring (7) underneath the outer portion of the connecting ring (8) very precisely. The connecting ring (4) that play a role to connect the upper can (3) and the lower can (5) together also provide a function to disconnect the lower can (5) and upper can (3). Due to the special design of the ring one can separate the container (2) into two cans easily, just by twisting the upper can (3) and lower can (5) with an opposite force acting simultaneously.

FIG. 4 show the connecting ring (4) has designed with two con-centric portions of the connecting ring and have punched with four slots and a sequence of small holes all along the border of the two portions of the connecting ring and plus a V-shape notch (10) along them so the twist force can cause the two rings separated by breaking those small holes and four slots along the border of the two con-centric portions of the connecting rings. And the connecting ring (4) itself is well bonded to the upper can (3) and lower can (5) from both side of the connecting ring (4), although it united with the two cans but still can be separated. FIGS. 4, 4A and 4B show the detail of the subject ring. The connecting ring (4) punched with 28 small holes $\times$ 1.45 mm $\phi$ and four long curved slots with 1.45 mm in width from center A to center B with a fifty degree span. The FIG. 4 only shows one fourth of the connecting ring's details. FIG. 4A shows the cross section of the punched slot of the subject connecting ring (4), and the FIG. 4B shows the cross section of the connecting ring (4). There is a V-shape notch (10) shown in cross section, and it is formed along the center line between the outer portion of the connecting ring (8) and the portion of the inner connecting ring (7), can help the ring's separation.

Figure 5:
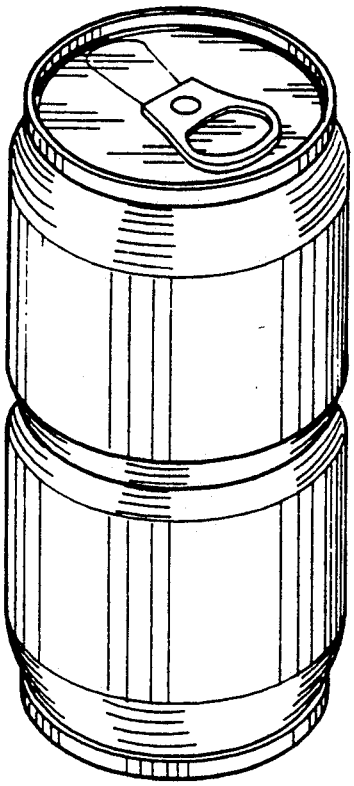
FIGS. 5, 5A and 5B shows the container its different types.
Figure 5A:
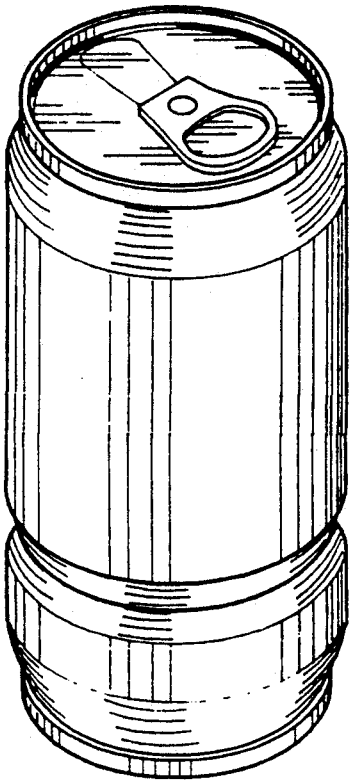
Figure 5B:
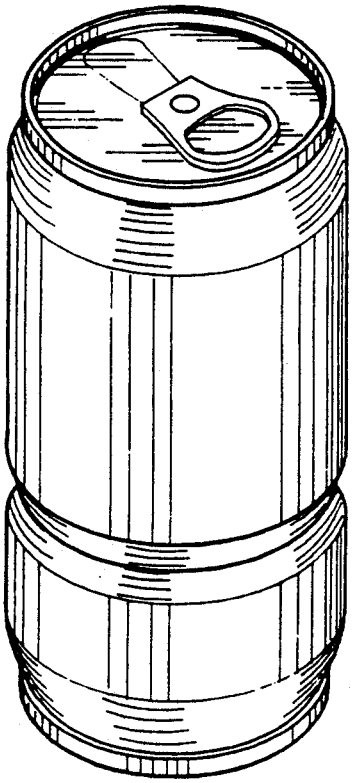

FIGS. 5, 5A and 5B show the different type of the container (2) and all using the connecting ring (4) and the bond material (9) to unite those different size cans. FIG. 5 type A container that is in half size of each can. FIG. 5A shows type B container that is $\frac{3}{4}$ upper can and $\frac{1}{4}$ lower can. FIG. 5B shows type C container that is $\frac{1}{3}$ top can and $\frac{2}{3}$ lower can. The other ratio of the cans may vary depending on the purpose of using of the container (2).

Figure 6:
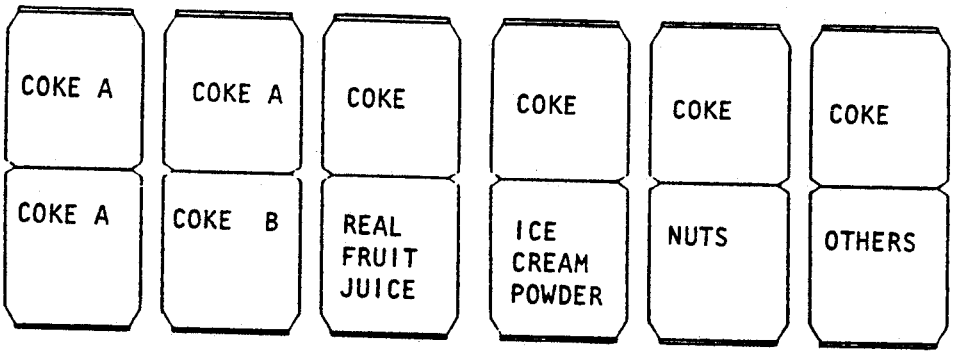
FIGS. 6, 6A, 6B, and 6C shows the packing system derived by this new container.
Figure 6A:
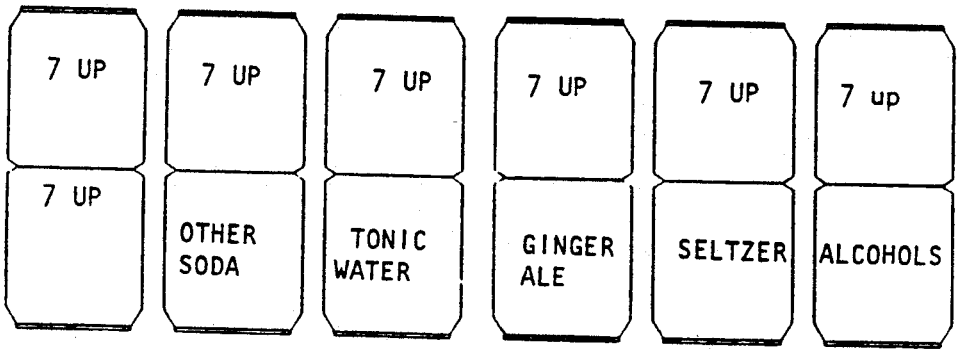
Figure 6B:
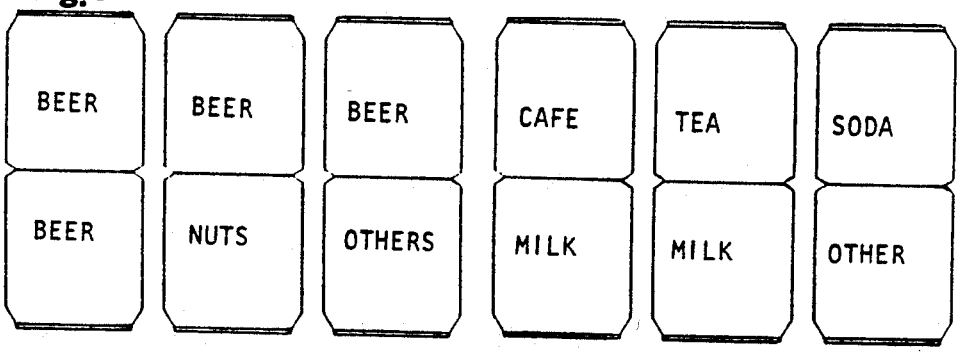
Figure 6C:
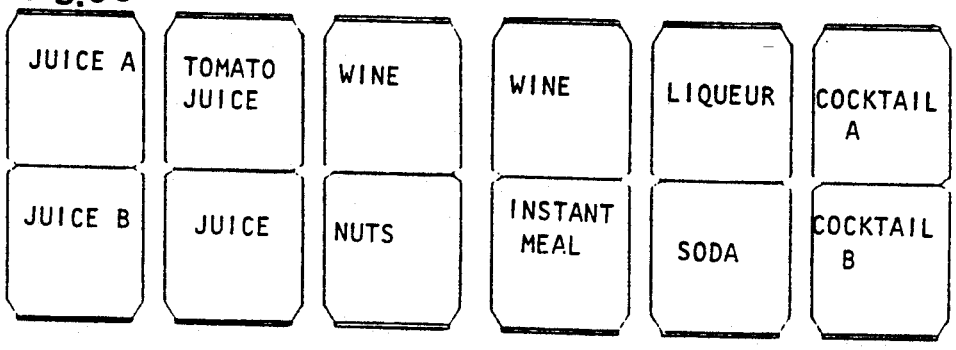

FIGS. 6, 6A, 6B and 6C show the container and its packing system derived by this new developed container. FIG. 6 shows the packing system from the basic of a coke to combine with all other kind of drinks or foods. This packing system provide more choice for the customer. Expanding the advantage of this container to all other different industry field is far beyond one's imagination now.

Figure 7:
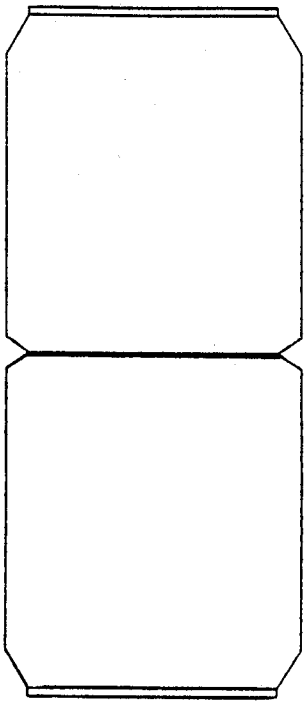
FIGS. 7, 7A, 7B, 7C, 7D, and 7E shows the different ways of connecting that protect by the patent.
Figure 7A:
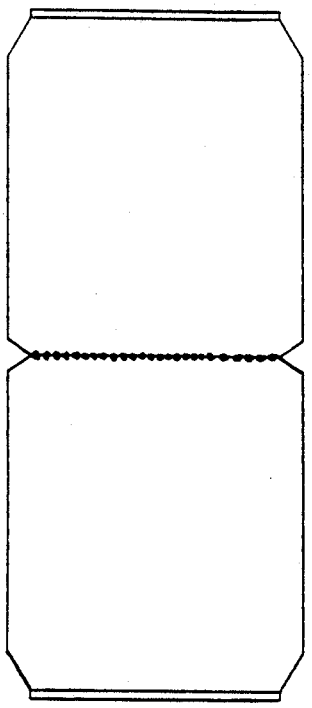
Figure 7B:
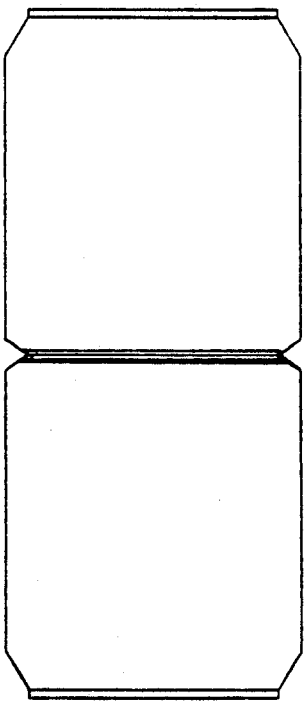
Figure 7C:
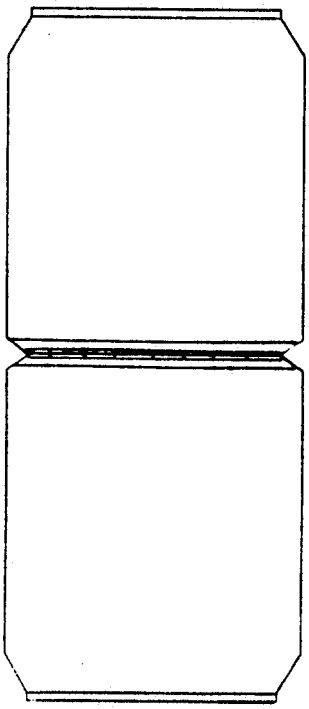
Figure 7D:
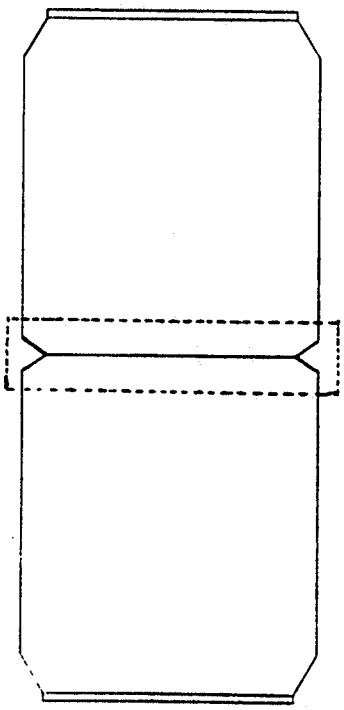
Figure 7E:
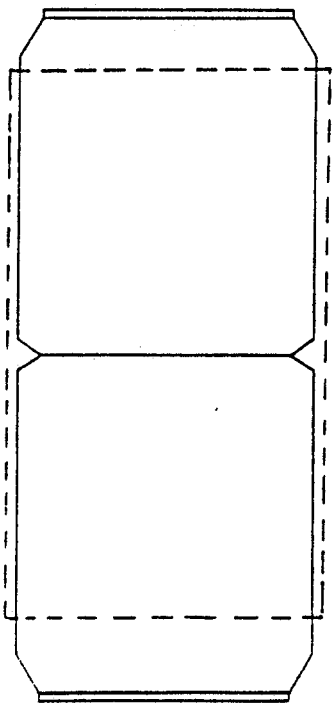

FIGS. 7, 7A, 7B, 7C, 7D, and 7E show the container have different united ways to hold two cans together. FIG. 7 by using special adhesive or glue or bond to hold these cans tightly. FIG. 7A by using aluminum welding technic to hold these cans together and can be separated by twisting both cans simultaneously. FIG. 7B by using a special spring ring to snap one can's top to the other can's bottom that welding with the spring ring. FIG. 7C using mechanism method to connect these two can together. FIG. 7D using any kind of extra union to hold these cans together. FIG. 7E using a thin shrinkable transparency polyester tubing to hold these cans tightly to form an united container.

From the description above, a number of advantages of my new design container become evident:

(a) This container is more function than the old aluminum can.

(b) This container its over all looking is more superior to the old aluminum can.
(c) This container is more stronger in structure than the old one.
(d) This container is designed for people who concern about the taste and the freshness.
(e) This container is for the people who think the current can is too big for them.
(f) This container is a hop for the food and drink industry to do more business with their new products.
(g) This container can let you share with your friends intimately.
(h) This container can let you enjoy more flavor and more taste.
(i) This container can save a lot money because its dual packing.
(j) This container can provide an instant mixing drink any where, and time.
(k) This container can provide drink and snack such like nuts, peanut . . . at the same time.
(l) This container can let you control your weight without drinking too much at a time.
(m) This container can let you drink one half and without worring the other half and giving you a feeling of freedom.
(n) This container can have two relative drink formula for some special purpose or treatment.
(o) This container can provide regular drink and fiber drink at the same time.
(p) This container can create hundreds different combinations of drink or drink with food.

Because this container has so many advantages that I can't write them all, just try it in the coming future and use your imagination to prove this new invention now.

OPERATION—FIGS. 1 TO 7

The container (2) is designed with two cans connecting by a connecting ring (4). The upper can (3) and lower can (5) are identical except their top cap's (1) diameter. The container (2) when it stacks one to another very easily. The connecting ring (4) is designed with two con-centric portions of the connecting ring what we called outer portion of the connecting ring (8) and inner portion of the connecting ring (7). A V-shape notch (10) is formed between outer portion of the connecting ring (8) and inner portion of the connecting ring (7) so this two portions of the connecting ring can be separated easily. In addition to this V-shape notch (10), there are a number of small holes punched along the common edge of outer portion of the connecting ring (8) and inner portion of the connecting ring (7), four slots are also punched, plus a V-shape notch (10) along the common edge of this two portions of the connecting ring, all this put in together, when two forces apply on both side of the both portions of the ring that is one force on the upper side of the outer portion of the connecting ring (8) and the other force on the opposite of the inner portion of the connecting ring (7) then a couple force effect twist the two portions of the connecting ring to separate easily. With a bond material (9) the upper side of the outer portion of the connecting ring (8) bonds to the bottom of the upper can (3), and the opposite of the inner portion of the connecting ring (7) bonds to the bottom of the lower can (5). Regarding the bond is a very special chemical agent and very strong, can pre-print on the both sides of the ring precisely then more the ring to the middle of the two cans' bottom then press the upper can (3) and lower can (5) together tightly with pressure and the container is completely finished. All those procedures can be designed with fully automatic continue equipment for mass production. And the cost is very low for this new container. But the functions of the container compare to its cost is much more value.

The packing system is derived from this new design of the container (2). As you can see from the FIG. 7 all different kinds of drink can be made by using this container. A entire food and drink industrial could sprout just by using this new design. A compact and clean and variety of choice will provide the market with a new life. The way of packing of the new container is also well considered. This new container is also packed with six containers as an unit. The sanitary problem of the top of the can is always complained by the aluminum can user. This design uses a new developed material called "Clean-Top" beverage carrier which developed by a joint effort of Du Pont Packaging, Wilmington, Del., Forma-Pack L.P., Stockton, Calif., and Nigrelli Systems, Kiel, Wis.

This new material of polyester can cover the entire top of beverage cans in six or twelve packs. It would replace the old six pack plastic rings, it is not a good design for the environment, which have been criticized by environmentalists, this new polyester can be recycled. And my container both on the top and bottom cap all covered by this new polyester "Clean-Top" material.

SUMMARY, RAMIFICATIONS, AND SCOPE

Now, I am going to summarize all the advantages of the container in following it allows the people to enjoy the beverage more different ways.
it expands the territory of the drink industry.
it fits more different level of the consumer's need.
it avoids the waste of money and materials.
it generates a lot of different food products for the market.
it gives people more convenience and more choice.
it provides more tastes of different drinks.

Although the description above contains many specificities. this should be not construed as limiting the scope of the invention but as merely providing illustrations of some of the presently preferred embodiments of this invention. For example, the connecting ring its detail design may be some what different in the construction but the basic idea of outer portion of the connecting ring and inner portion of the connecting ring separate bond to the cans is still unchanged.

Thus the scope of the invention should be determined by the appended claims and their legal equivalents, rather than by the samples given.

I claim:

1. A ring for detachably connecting two cans together end-to-end when said ring is provided with a bonding material; said ring comprising an inner circumferential portion and an integral concentric outer circumferential portion such that said portions share a common border between them; said ring further comprising a plurality of elongated curved slots and a plurality of groups, each group comprising a number of circumferentially grouped small adjacent holes, said slots and groups of holes alternating with each other in a repetitive array of slots and groups of holes circumferentially around said ring and positioned along the common border between said inner portion and said outer portion of said ring; said ring also including at least two V-shaped notches which are also positioned along the common border; said ring being dimensioned to fit the ends of two cans to be secured to each other end-to-end; said slots, small holes and associated V-shaped notches being configured and dimensioned relative to each other and said ring such that when said bonding material is applied both to the upper surface of said ring along said outer portion and on the lower surface of said ring along said inner portion and the cans to be joined are joined to each other end-to-end by being bonded to said upper and lower surface of said ring, respectively, and such that when said joined cans are to be disconnected, twisting said cans in opposite directions will cause said inner portion of said ring and said outer portion of said ring to remain bonded to their respective cans and cause said inner portion and said outer portion of said ring to completely separate from each other into two separate rings, thus separating the cans from each other.

2. A beverage container assembly comprising:

(a) a first normally closed beverage container having a first top and first bottom wherein said first top has a first opening means operable to gain access into said first normally closed beverage container;

(b) a second normally closed beverage container having a second top and a second bottom wherein said second top has a second opening means operable to gain access into said second normally closed beverage container;

wherein said first and second normally closed containers are joined to each other with the first bottom of said first container connected to said second bottom of said second container by said connecting ring of claim 1 such that said first bottom is bonded by said bonding material to said upper surface of said ring and said second bottom is bonded to said lower surface of said ring.

* * * * *